US005259464A

United States Patent [19]

Bartels et al.

[11] Patent Number: 5,259,464

[45] Date of Patent: Nov. 9, 1993

[54] PERCUSSION MECHANISM FOR A DRILL ROD UNIT

[75] Inventors: Robert-Jan Bartels; Hans-Dieter Piotrowski, both of Essen, Fed. Rep. of Germany

[73] Assignee: Krupp Maschinentechnik Gesellschaft mit beschränkter Haftung, Essen, Fed. Rep. of Germany

[21] Appl. No.: 872,809

[22] Filed: Apr. 24, 1992

[30] Foreign Application Priority Data

Apr. 24, 1991 [DE] Fed. Rep. of Germany ..... 4113323

[51] Int. Cl.[5] ..... E21B 1/02

[52] U.S. Cl. ..... 173/91; 173/129

[58] Field of Search ..... 173/129, 132, 105, 91; 175/135, 162, 173, 189

[56] References Cited

U.S. PATENT DOCUMENTS

| | | | |
|---|---|---|---|
| 2,802,340 | 8/1957 | Tallman | 173/129 X |
| 3,701,386 | 10/1972 | Feucht | 173/78 |
| 4,993,504 | 2/1991 | Rodert et al. | 173/105 X |
| 5,174,386 | 12/1992 | Crover | 173/132 X |

FOREIGN PATENT DOCUMENTS

| | | | |
|---|---|---|---|
| 0190669 | 11/1989 | European Pat. Off. . | |
| 2428236 | 6/1976 | Fed. Rep. of Germany . | |
| 2717813 | 11/1977 | Fed. Rep. of Germany | 173/129 |
| 2816737 | 10/1979 | Fed. Rep. of Germany . | |
| 2918631 | 11/1979 | Fed. Rep. of Germany . | |
| 3306487 | 9/1983 | Fed. Rep. of Germany | 173/132 |
| 3503893 | 10/1985 | Fed. Rep. of Germany . | |
| 554395 | 4/1977 | U.S.S.R. . | |
| 1416793 | 8/1988 | U.S.S.R. . | |
| 632935 | 12/1949 | United Kingdom | 173/129 |

*Primary Examiner*—Hien H. Phan
*Assistant Examiner*—Rinaldi Rada
*Attorney, Agent, or Firm*—Spencer, Frank & Schneider

[57] ABSTRACT

A drilling apparatus includes a drill rod unit having at least one drill rod; a percussion mechanism having a housing; a percussion piston having an axis and being slidably received in the housing; and a hydraulic system for generating pressures in the housing for effecting an axial reciprocation of the percussion piston in the housing for delivering blows to the drill rod unit in a direction parallel to a direction of reciprocation. The housing has opposite, axially aligned open ends and the percussion piston has a throughgoing axial passage in alignment with the open ends of the housing. The drill rod unit extends into the axial passage and has a counterface situated in a path of travel of the percussion piston for being impacted by an end thereof. The percussion mechanism is receivable on the drill rod unit at either selected side of the counterface for delivering blows to the drill rod unit in a selected one of two opposite directions.

4 Claims, 4 Drawing Sheets

PERCUSSION MECHANISM FOR A DRILL ROD UNIT

CROSS REFERENCE TO RELATED APPLICATION

This application claims the priority of German Application No. P 41 13 323.4 filed Apr. 24, 1991, which is incorporated herein by reference.

BACKGROUND OF THE INVENTION

This invention relates to a percussion mechanism for a drill rod unit particularly for drilling into rock formation or providing anchor holes. The percussion mechanism includes a percussion piston which is guided in a cylinder defined within a housing and which is moved back and forth by hydraulic pressure.

The non-uniform and sometimes unpredictable composition of rock formations or layers to be drilled often leads to difficulties in case of plain rotary drilling. Particularly when working with highly abrading materials, the drilling head carried at the end of the drill rod unit is exposed to increased wear which may result in a significant reduction of the drilling rate. Thus, the strata to be worked on may be often drilled through in a economical manner only by imparting—at least periodically for predetermined lengths of time—blows by a percussion mechanism.

German Patent No. 3,503,893 discloses a drilling apparatus for a dual head drilling wherein the drilling rod unit is formed of a tubular outer rod and an inner rod extending within the outer rod. While the outer rod is connected solely to a rotary drive, the inner rod is provided with a percussion mechanism.

The known drilling apparatus may be operated such that the outer rod—contrary to the inner rod which is also exposed to the action of the percussion mechanism—performs solely a rotary motion, or the blows imparted on the inner rod are also transmitted to the outer rod by an annular collar. Further, it is feasible to disconnect the percussion mechanism to thus work exclusively by rotating the outer and inner rods.

In the above-outlined arrangement, dependent on the operating condition, at times a significant jacket friction occurs or resistances are encountered (for example, caused by material falling into the bore hole behind the drilling head) which render drilling by the outer rod or its withdrawal difficult or even impossible.

To support the withdrawing (pulling) step, German Offenlegungsschrift (application published without examination) 29 18 631 discloses the provision of a percussion mechanism with an additional piston whose purpose is to maintain a continuous contact between the counterface of the tool and the percussion piston. In any event, in a percussion mechanism constructed in this manner—which is a component of the drilling apparatus—the resistances encountered during the withdrawing process may not always be overcome.

SUMMARY OF THE INVENTION

It is an object of the invention to provide an improved hydraulically driven percussion mechanism for a drill rod unit which may be adapted to different operating conditions in an economically feasible manner. In particular, it is an object to so design the percussion mechanism that the earlier-described problematic drilling steps may be economically performed.

This object and others to become apparent as the specification progresses, are accomplished by the invention, according to which, briefly stated, the drilling apparatus includes a drill rod unit having at least one drill rod; a percussion mechanism having a housing; a percussion piston having an axis and being slidably received in the housing; and a hydraulic system for generating pressures in the housing for effecting an axial reciprocation of the percussion piston in the housing for delivering blows to the drill rod unit in a direction parallel to a direction of reciprocation. The housing has opposite, axially aligned open ends and the percussion piston has a throughgoing axial passage in alignment with the open ends of the housing. The drill rod unit extends into the axial passage and has a counterface situated in a path of travel of the percussion piston for being impacted by an end thereof. The percussion mechanism is receivable on the drill rod unit at either selected side of the counterface for delivering blows to the drill rod unit in a selected one of two opposite directions.

In case the drill rod unit—as viewed cross-sectionally—has only a single rod, the bilateral arrangement may be designed such that the drill rod unit projects into the throughgoing bore or in a normal case passes therethrough whereby the percussion piston works directly or indirectly (for example, with the intermediary of an anvil member mounted on the drill rod unit) in the striking direction on the drill rod unit. In case of a dual drill rod unit (formed of a hollow outer rod and an inner rod passing therethrough), the mutual arrangement may be so designed that either only the inner rod or the outer and inner rod project into the percussion piston which drives the outer rod or is passed therethrough.

The invention further presupposes that the drill rod unit (thus, the outer rod in case of a dual drill rod unit) has a counterface exposed to the blows of the percussion piston and may be manipulated in such a manner that a conversion of the percussion mechanism with the resulting reversal of the impacting direction is possible. Advantageously, the drill rod unit is formed of longitudinal portions detachable from one another. This feature which is present in a normal case in any event, permits or simplifies the positioning of the percussion mechanism. By separating the longitudinal portions from one another in the zone of the percussion mechanism, the latter may be pulled off the drill rod unit which surrounds it and by rotating the same about an imaginary axis transverse to the longitudinal axis, the percussion mechanism may be inverted. As a result, the percussion mechanism which is first effective in the direction of the drill feed, may, after being inverted into the opposite, withdrawing (pulling) direction, directly or indirectly deliver blows to the drill rod unit (for example, strike the outer rod in case of a dual drill rod unit) with the intermediary of an anvil member. Thus, the invention provides the possibility that the percussion mechanism—dependent upon its location where it is coupled to the drill rod unit—be used for urging the drill rod unit in the normal drill feed direction, or into the opposite, pulling (withdrawing) direction.

The diameter of the throughgoing passage of the percussion piston has to be dimensioned such that taking into consideration the greatest possible bend of the drill rod unit, such diameter is greater (including a sufficient clearance) than the outer diameter of the drill rod unit. Based on the magnitudes considered in this construction, the distance between the percussion piston and such outer diameter should be at least a few millimeter.

According to a further feature of the invention, the percussion mechanism is so constructed that the percussion piston projects axially from the housing only at that housing end which is oriented towards the anvil. The construction may be designed such that the axial length of the percussion piston is shorter than that of the housing.

A trouble-free operation of the percussion mechanism is enhanced by a further feature of the invention, according to which the counterface of the anvil is of conical shape oriented towards the percussion piston which, in turn, has a striker face conforming to the conical shape of the anvil.

In order to provide a structure required for an inversion of the percussion mechanism relative to th drill rod unit, according to a further feature of the invention, the counterface is formed on a ring-shaped anvil which is detachable and is supported on an abutment face of the drill rod unit. The ring-shaped anvil may be formed of a plurality of annular segments which can be screwed to one another. According to a further embodiment of the ring-shaped anvil, the latter is formed of a plurality of hinge-jointed annular segments having a securing element such as a tightening screw.

In case the drilling apparatus has a dual drill rod unit such as disclosed in German Patent 3,503,893, the percussion mechanism may also be coupled to the associated outer drill rod. Such an embodiment—in which the throughgoing passage provided in the percussion piston receives the inner rod or the outer and inner rod—provides the possibility to use an additional impacting energy to advance or to withdraw the outer drill rod held firmly by jacket friction or by material that has fallen into the bore hole.

DESCRIPTION OF THE PREFERRED EMBODIMENTS

Figure 1:
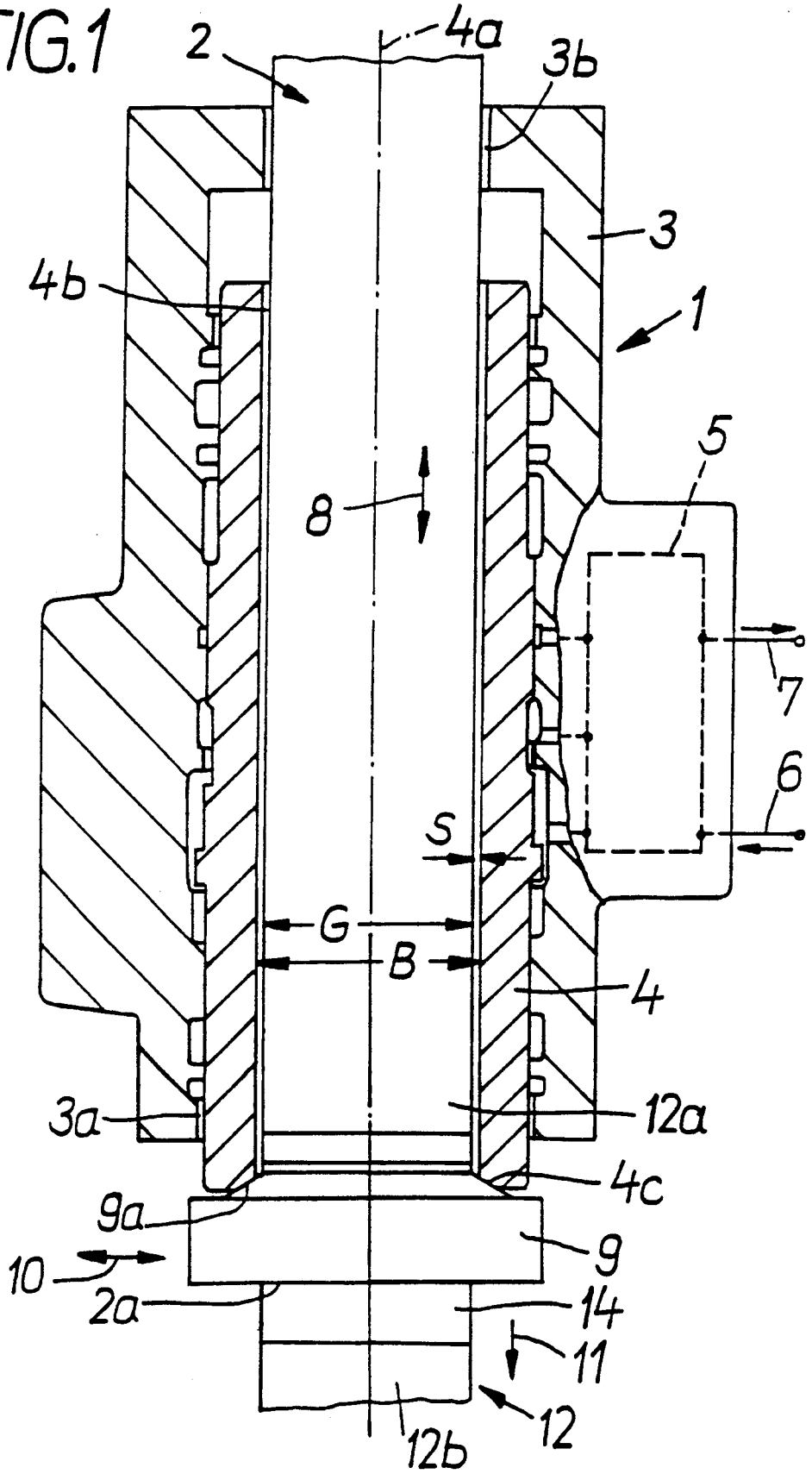
FIG. 1 is a schematic sectional view of a percussion mechanism according to a preferred embodiment of the invention wherein the hollow percussion piston delivers blows, in the direction of drilling feed, to a drill rod unit formed of a single drill rod.
Figure 1A:
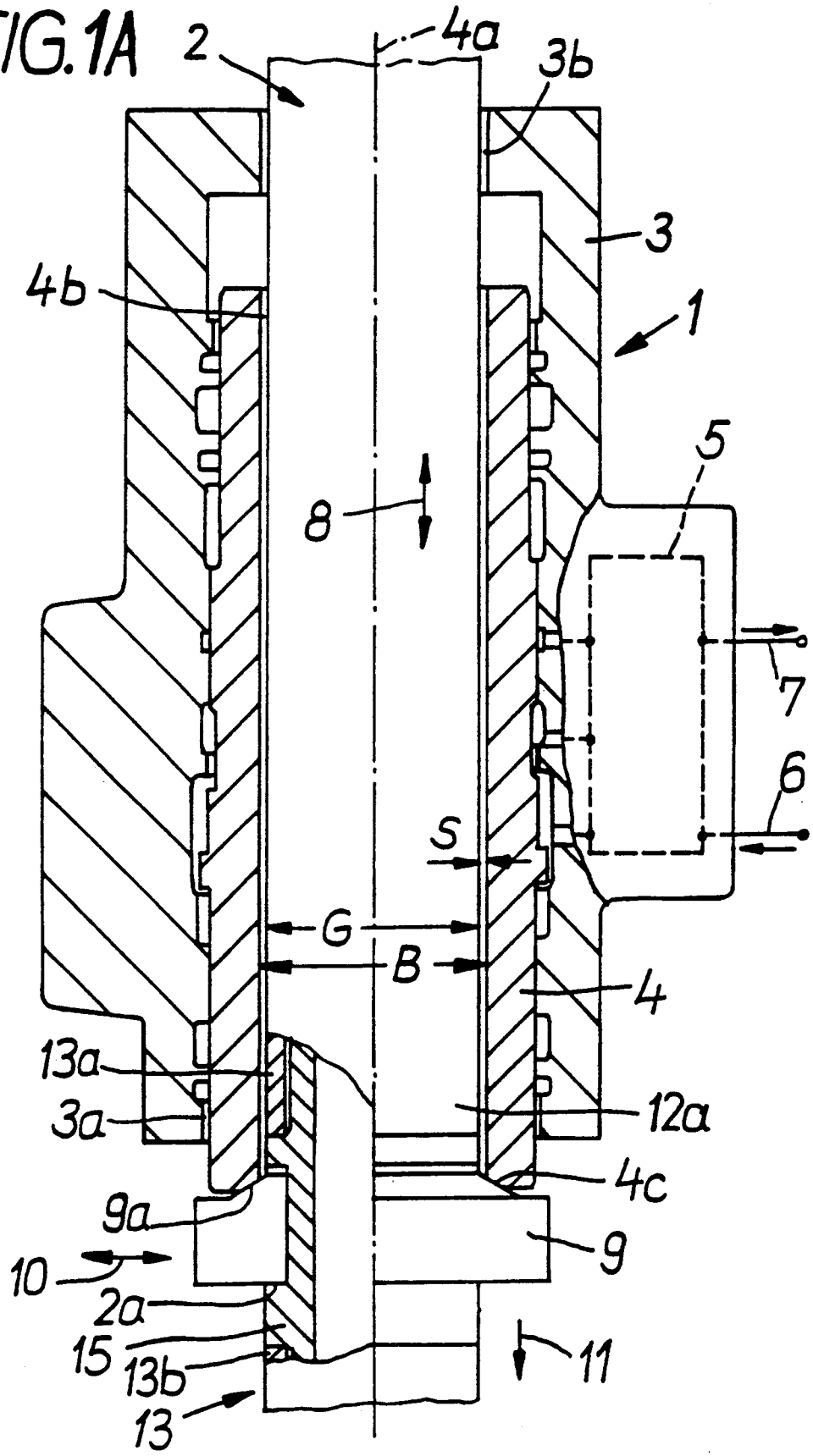
FIG. 1A is a schematic sectional view of a percussion mechanism according to a preferred embodiment of the invention wherein the hollow percussion piston delivers blows, in the direction of drilling feed, to an outer drill rod of a dual drill rod unit.

Turning to FIGS. 1 and 1A, a percussion mechanism generally designated at 1, by means of which blows may be imparted on a drill rod unit generally designated at 2, has a housing 3 and a percussion piston 4 guided in the housing 3. The piston 4 has a length dimension (measured parallel to its longitudinal axis 4*a*) which is shorter than the axial length of the housing 1 and which has a throughgoing axial passage 4*b* having a passage diameter B.

Intermediate chambers (not illustrated in detail) between the percussion piston 4 and the housing 3 are connected through a control device 5 with a supply conduit 6 for delivering pressurized hydraulic fluid and with a return (discharge) conduit 7. Forward and return strokes of the percussion piston 4 are generated as shown by the double-headed arrow 8 by establishing, with the aid of the control device 5, a hydraulic communication with the intermediary of the supply conduit 6 between appropriate housing chambers and a non-illustrated hydraulic pressure source or a non-pressurized return conduit 7. The control device 5 and its cooperation with the percussion piston 4, described, for example, in German Patent No. 2,428,236, do not pertain to and have no bearing on the invention. It is merely of importance that the percussion piston 4 may alternately execute a working motion in the striking direction (that is, downwardly as viewed in FIG. 1) and a return stroke (that is, upwardly in FIG. 1) relative to the housing 3.

The structure and the mutual arrangement of the components 3 and 4 relative to one another is so selected that the percussion piston 4 projects from the housing 3 solely in the striking direction, that is, in the downward direction as viewed in FIG. 1. The housing 3, similarly to the percussion piston 4, is open at opposite axial ends, that is, it has at its front end oriented in the striking direction an exit bore 3*a*adapted to the outer diameter of the percussion piston 4 and at its rearward end has a passage bore 3*b* adapted to the outer diameter G of the drill rod unit 2.

The drill rod unit 2 which is to be driven by the percussion piston 4 and which passes axially through the percussion piston 4 and through the housing 3, carries externally of the housing 3 a detachably mounted anvil constituted by a multi-part ring 9 which engages, in the striking direction of the percussion piston 4, an abutment shoulder 2*a* of the drill rod unit 2. The double-headed arrow 10 indicates the radial direction (which may thus also be perpendicular to the plane of drawing FIG. 1) in which the anvil ring 9 may be pulled off or mounted on the drill rod unit 2. The anvil ring 9 has on its side oriented towards the percussion piston 4 a conical counterface 9*a* projecting axially therefrom which, during operation of the percussion mechanism, is impacted by the striking face 4*c* formed on the percussion piston 4 and conforming to the shape of the conical projection 4*c*. The shapes of the surfaces 9*a* and 4*c* aid in the centering of the drill rod unit 2 within the axial passage 4*b* of the percussion piston 4. The clearance s between the drill rod unit 2 and the percussion piston 4 is a few millimeter.

As the percussion mechanism of FIG. 1 operates, the percussion piston 4, with its striking face 4*c*, delivers blows to the anvil ring 9 which transmits the striking forces to the drill rod unit 2 through the abutment shoulder 2*a*, whereby the drill rod unit 2 is driven in the direction of the drill feed designated by arrow 11. The drill rod unit 2 may be formed of a single drill rod 12 (FIG. 1) which may be cross-sectionally solid or may be formed of a dual construction (FIG. 1A) composed of a hollow outer drill rod 13 and a non-illustrated inner drill rod extending coaxially within the outer drill rod 13.

To make possible a removal of the percussion mechanism 1 from the drill rod unit 2 and its inversion after the release of the anvil ring 9, the drill rod 12 (FIG. 1)

is formed of a plurality of longitudinally consecutive length portions 12*a*, 12*b* or the outer drill rod 13 (FIG. 1A) is formed of a plurality of longitudinally consecutive length portions 13*a*, 13*b*. The length portions of the drill rod unit are releasably attached to one another by a coupling part 14 (FIG. 1) or 15 (FIG. 1A) which receives the anvil ring 9.

Figure 2:
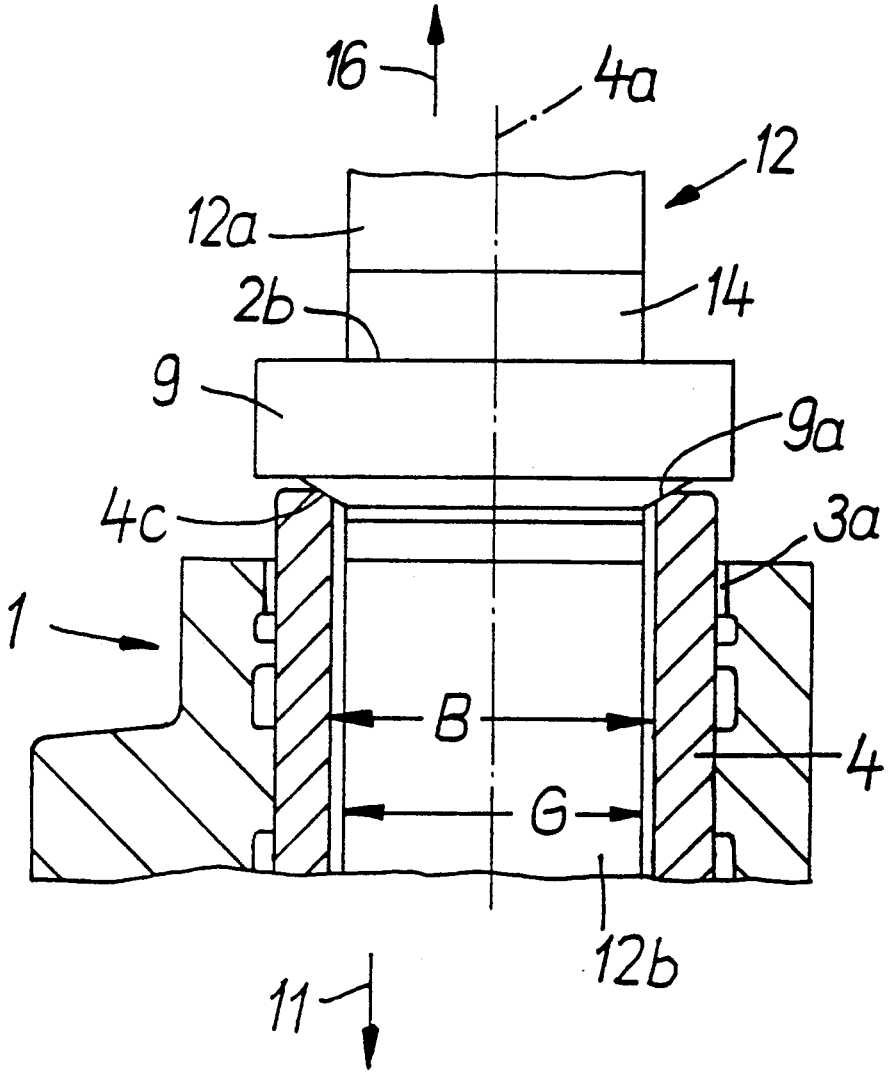
FIG. 2 is a sectional view of the construction shown in FIG. 1 in the zone of the striking face of the percussion piston, illustrated in an inverted position of the percussion mechanism.

Upon completion of the inversion step in which the percussion mechanism 1 is turned 180° about an imaginary axis oriented perpendicularly to the longitudinal axis 4*a*, there is obtained the arrangement as illustrated in FIG. 2 which shows the single drill rod of the FIG. 1 embodiment. It is thus seen that the percussion mechanism 1 is now situated below the anvil ring 9 which itself has been inverted and which engages an upper abutment shoulder 2*b* of the drill rod 12, having the same function as the earlier-discussed abutment shoulder 2*a*. Thus, the percussion mechanism 1 assumes a position in which the percussion piston 4 can deliver blows to the drill rod 12 by means of surface 4*c* of the percussion piston 4 and surface 9*a* of the anvil ring 9, so that the drill rod unit is now driven upwardly, that is, in the direction of withdrawal as indicated by the arrow 16′ and thus the drill rod unit is moved out of the non-illustrated drill hole. The same considerations apply when the outer rod 13 of a dual drill rod unit (FIG. 1A) is impacted by the percussion piston 4 with the intermediary of the anvil ring 9.

Figure 3:
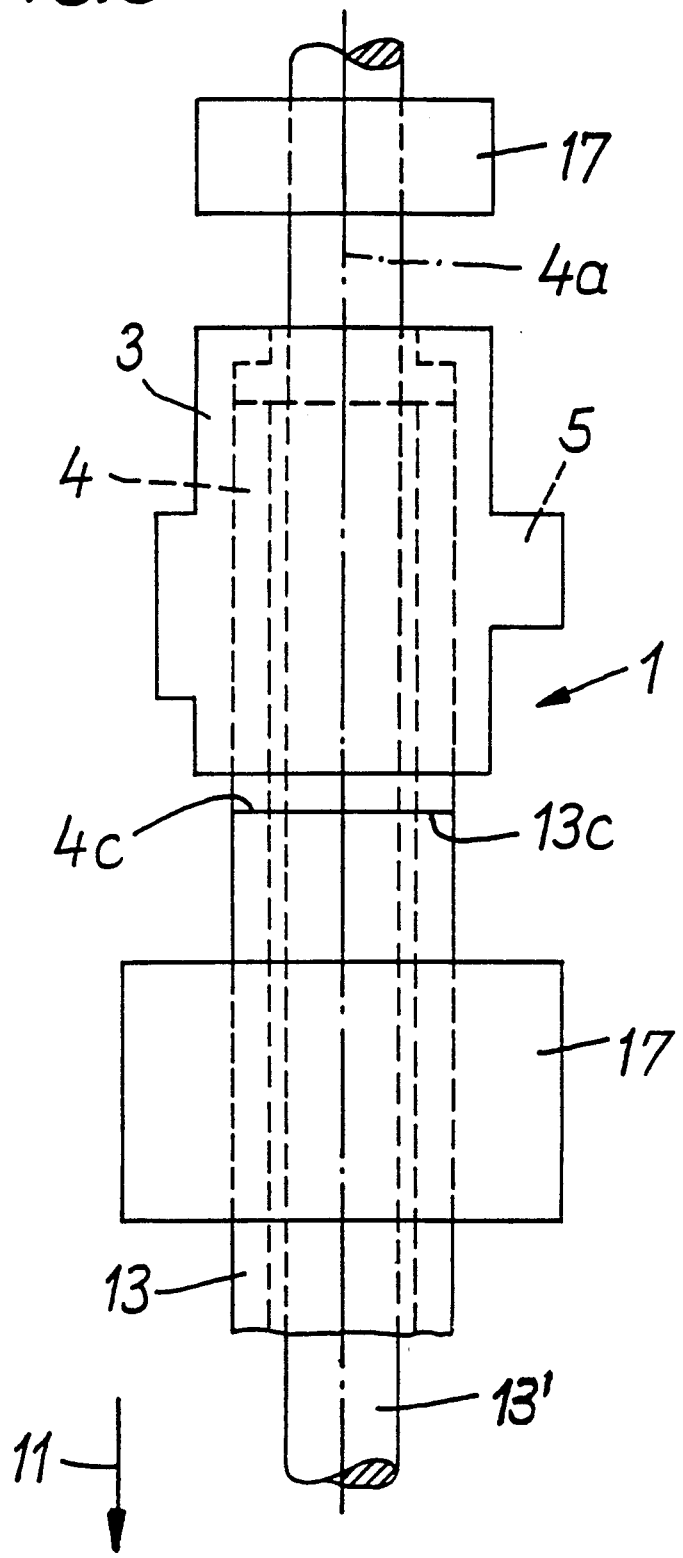
FIG. 3 is a schematic elevational view of a drilling apparatus with percussion mechanism having a percussion piston according to the invention which delivers direct blows to the outer drill rod of a dual drill rod unit.

Turning to FIG. 3, there is shown therein a further, different mode of use of the percussion mechanism 1. The latter is, relative to a dual drill rod unit (FIG. 1A), formed of a tubular outer rod 13 and an inner rod 13′ accommodated in the outer rod 13 in such a manner that the hollow percussion piston 4 may directly strike with its face 4*c* the rear face 13*c* of the outer rod 13. The rotary drives 17 and 17′ for the outer rod 13 and the inner rod 13′ are arranged, as viewed in the direction of drill feed (arrow 11), downstream and upstream of the percussion mechanism 1, respectively.

The embodiment illustrated in FIG. 3 has the advantage that the percussion mechanism 1 may be retrofitted in a multi-part drill rod unit having inner and outer drill rods.

It will be understood that the above description of the present invention is susceptible to various modifications, changes and adaptations, and the same are intended to be comprehended within the meaning and range of equivalents of the appended claims.

What is claimed is:

1. In a drilling apparatus including a drill rod unit having at least one drill rod;

a percussion mechanism having a housing; a percussion piston having an axis and being slidably received in the housing; and hydraulic means for generating pressures in the housing for effecting an axial reciprocation of the percussion piston in the housing for delivering blows to the drill rod unit in a direction parallel to a direction of reciprocation;

the improvement wherein said housing has opposite, axially aligned open ends and said percussion piston has a throughgoing axial passage in alignment with the open ends of the housing; at least one part of said drill rod unit extending into said axial passage; said drill rod unit having an anvil defining a counter face situated in a path of travel of said percussion piston for being impacted by an end of said percussion piston; said percussion mechanism being receivable on said drill rod unit in one of two, mutually 180° inverted, selected positions and said anvil being receivable on said drill rod unit at a selected side of said percussion mechanism for delivering blows to said drill rod unit by said percussion mechanism with an intermediary of said counterface of said anvil in a selected one of two opposite directions; said percussion piston projecting from sand housing solely in a direction towards said anvil.

2. A drilling apparatus as defined in claim 1, wherein said percussion piston has an axial length shorter than an axial length of said housing.

3. A drilling apparatus as defined in claim 1, wherein said counterface conically projects towards said percussion piston and further wherein said end of said percussion piston has a striking face shaped to conform to said counterface.

4. A drilling apparatus as defined in claim 1, wherein said anvil is an annular anvil surrounding said drill rod unit and engaging an abutment face of said drill rod unit for transmitting striking forces from said annular anvil to said drill rod unit.

* * * * *